United States Patent [19]

Cole

[11] Patent Number: 4,872,468

[45] Date of Patent: Oct. 10, 1989

[54] SAFETY UMBRELLA

[76] Inventor: Ronald S. Cole, 209 Bache Ave., Staten Island, N.Y. 10306

[21] Appl. No.: 258,004

[22] Filed: Oct. 14, 1988

[51] Int. Cl.[4] ..... F21V 33/00

[52] U.S. Cl. ..... 135/16; 135/DIG. 10; 135/33 R; 135/34; 362/102; 362/32

[58] Field of Search ..... 135/16, 33, 34, DIG. 10; 362/102, 32

[56] References Cited

U.S. PATENT DOCUMENTS

| | | | |
|---|---|---|---|
| 1,051,370 | 1/1913 | Hertz | 135/DIG. 10 X |
| 1,177,241 | 3/1916 | Gay | 135/DIG. 10 X |
| 1,659,346 | 2/1928 | Beatty | 135/DIG. 10 X |
| 2,734,124 | 2/1956 | Funk | 135/DIG. 10 X |
| 3,275,815 | 9/1966 | Golaz | 135/DIG. 10 X |
| 3,275,815 | 9/1966 | Petroff et al. | 135/DIG. 10 X |
| 3,281,586 | 10/1966 | Gonzalez | 135/DIG. 10 X |
| 3,498,306 | 3/1970 | Edelling | 135/33 R |
| 4,031,381 | 6/1977 | Carver | 135/DIG. 10 X |
| 4,208,701 | 6/1980 | Schock | 362/102 X |
| 4,415,953 | 11/1983 | Shepherd | 362/32 |
| 4,513,692 | 4/1985 | Kuhnsman et al. | 362/102 X |
| 4,617,751 | 10/1986 | Johansson | 362/32 X |
| 4,773,920 | 10/1988 | Seibert et al. | 362/32 X |
| 4,807,095 | 2/1989 | Bell | 362/32 X |

FOREIGN PATENT DOCUMENTS

| | | | |
|---|---|---|---|
| 3603397 | 5/1987 | Fed. Rep. of Germany | 135/16 |
| 8605858 | 10/1986 | PCT Int'l Appl. | 362/32 |
| 610501 | 4/1979 | Switzerland | 135/DIG. 10 |
| 2073930 | 10/1981 | United Kingdom | 362/32 |

*Primary Examiner*—David A. Scherbel
*Assistant Examiner*—Lan Mai
*Attorney, Agent, or Firm*—Richard L. Miller

[57] ABSTRACT

This umbrella is designed to provide added safety to a user by making the user more visible in darkness to a motorist. Primarily, it consists of a strip on its canopy that is both reflective and will glow when light is provided by either an on board light system or externally from passing car headlights etcetera. The on board lighting system includes a handle for a pole, a battery, a bulb, and a reflector, and a switch for closing a circuit to cause light to be emitted from at least one end of the handle.

2 Claims, 1 Drawing Sheet

SAFETY UMBRELLA

BACKGROUND OF THE INVENTION

The instant invention relates generally to umbrellas, and more particularly, to a safety umbrella.

Numerous umbrellas have been provided in the prior art that are adapted to protect a person from precipitation. For example, U.S. Pat. Nos. 1,836,034 of Luchansky; 1,177,241 of Gay; and 754,631 of Allen all are illustrative of such prior art. While these units may be suitable for the particular purpose to which they address, they would not be as suitable for the purpose of the present invention as hereafter described.

SUMMARY OF THE INVENTION

A primary object of the present invention is to provide a safety umbrella that will overcome the shortcomings of the prior art devices.

Another object is to provide a safety umbrella that will be of such design as to include reflective and glowing portions in the overhead canopy.

An additional object is to provide a safety umbrella that will be of such design as to also include a switch operable flashlight in its handle.

A further object is to provide a safety umbrella that is simple and easy to use.

A still further object is to provide a safety umbrella that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
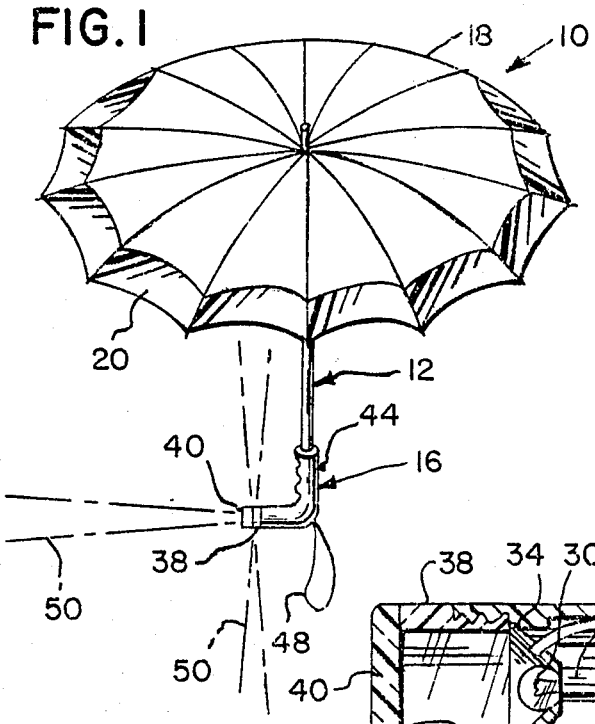
FIG. 1 is a diagrammatic perspective view of the instant invention.

Turning now descriptively to the drawings, in which like reference characters denote like elements throughout the several views, an umbrella 10 is shown to include a conventional pole 12 having an end fixedly secured in an opening 14 through a flashlight handle 16, which in this instance is L-shaped in configuration and fabricated of plastic material. A ribbed canopy 18 is provided and attached to the other end of pole 12 and includes a reflective and glowing outer strip 20 secured to the fabric thereof, in a manner not shown. This strip 20 is designed to make the user of umbrella 10 more visible during inclement weather.

Figure 2:
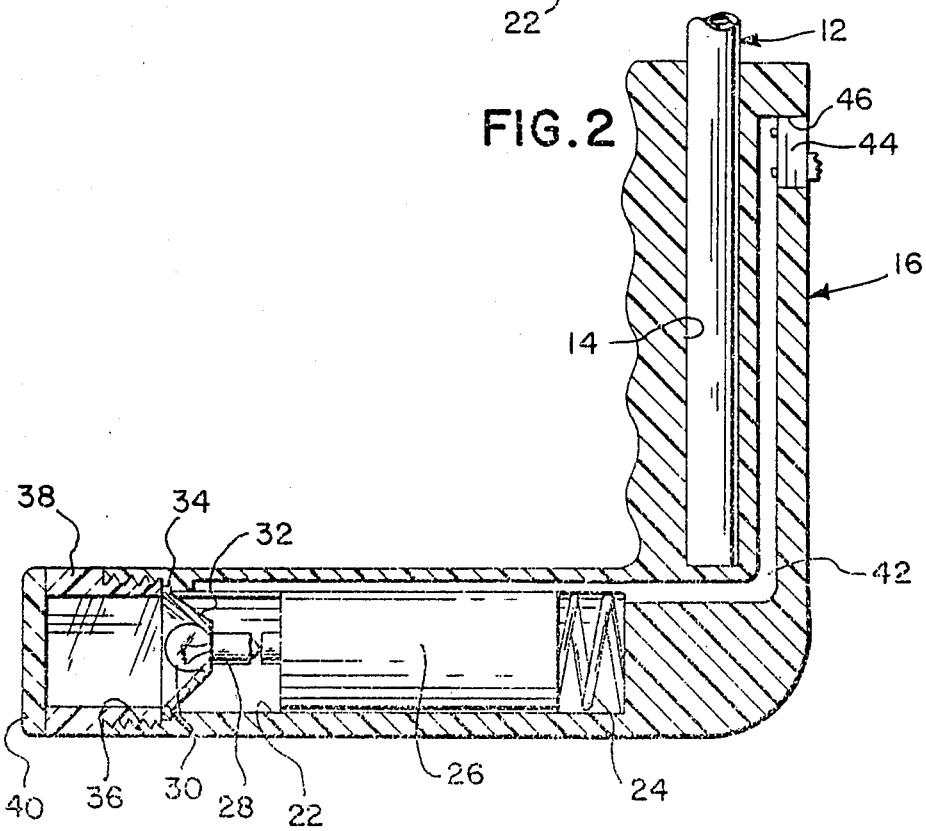
FIG. 2 is a diagrammatic fragmentary side cross sectional view of a portion of the instant invention.

Referring now more particularly to FIG. 2, a bore 22 in handle 16 includes a coil spring 24 that is biased against the rear portion of the handle 16 and urges against a battery 26 that is removable for replacement. The opposite end of the battery 26 urges against the base 28 portion of a bulb 30 by spring pressure of spring 24, and bulb 30 is received in a reflector 32 that is removable and seats against a recess 34. The open end of bore 22 is provided with internal threads 36 that engage with similar threads externally provided on one end of colored translucent lens cap 38 having a clear plastic lens 40 fixedly secured thereto.

A passageway 42 is provided in handle 16 and intersects with the bore 22, for receiving wire (not shown) that connects the battery 26, the bulb 30, and the spring 24 with a handle switch 44 secured within an opening 46. A flexible carry strap 48 is also fixedly secured to handle 16 as shown in FIG. 1, and light 50 is emitted through lens cap 38 and lens 40 as illustrated.

In use, umbrella 10 is employed in the usual manner for protection against precipitation, and on dark days or at night, the user closes the switch 44 in the handle 16, which closes the circuit to the bulb 30 that gives the user better visibility to motorists. The strip 20 provides added visibility for even greater safety to the user of umbrella.

Figure 3:
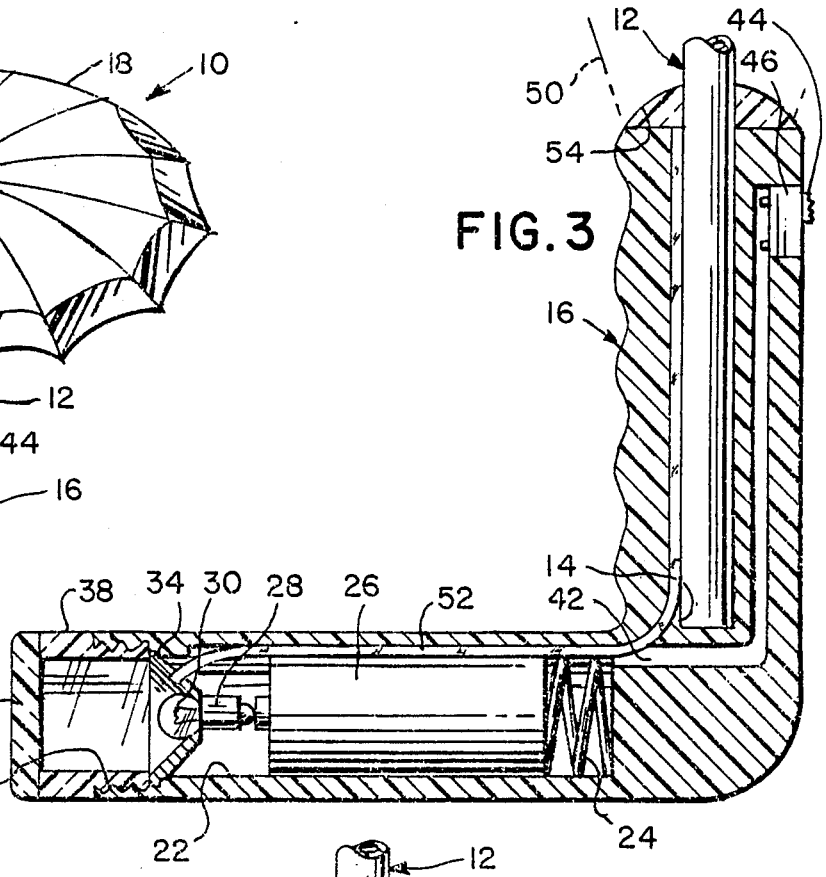
FIG. 3 is a view similar to FIG. 2, but illustrating a second embodiment utilizing a fiber optic illuminating element.

Looking now at FIG. 3, handle 16 is modified to include an optical fiber 52 received in passageway 42 and alongside pole 12, one end being received in an opening provided through reflector 32, and the other end being engaged with a second and domed lens 54, causing some of the light from bulb 30 to be transmitted out from domed lens 54.

In use, umbrella 10 functions in the same manner heretofore described, with the exception, that the optical fiber 52 causes some light 50 to also be directed upward.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A safety umbrella which comprises a pole, a flashlight handle secured to said pole, for providing better visibilitiy to passing motorists, and a canopy secured to said pole having a glowing and reflective strip, for adding visibility to said passing motorists, said flashlight handle being formed in one piece of plastic material in an L-shaped configuration having a base portion extending horizontally from a vertical, gripping portion with the umbrella opened in an upright, protective condition, a bore extending into the base portion from the free end thereof and a battery, a bulb, a reflector and a coil spring received in said bore, a threaded lens cap threadedly received on the free end of said base portion, a transparent lens fixedly secured to said lens cap closing the bore, with the lens and reflector having their optical axes extending along the handle base portion so as to direct light from the bulb through the free end of the bore in a horizontal direction, an on-off switch being mounted at an upper end of said gripping portion of said handle and circuit means extending between said on-off switch, said battery and said bulb, the vertical, gripping portion of the handle being formed with a bore extending axially inwardly from an uppermost end thereof providing a socket receiving said pole whereby said handle is secured to said pole, said flashlight handle further comprises lighting means that includes an optical fiber having one end fixedly secured in an opening provided through said reflector, and another end of said optical fiber engages with an upwardly domed lens fixedly secured to a top of the gripping portion of said flashlight handle of said umbrella.

2. A safety umbrella which comprises a pole, a flashlight handle secured to said pole, for providing better visibility to passing motorists, and a canopy secured to said pole having a glowing and reflective strip fixedly secured to a border edge thereof, for adding visibility to passing motorists, said flashlight handle being formed in one piece of plastic material in an L-shaped configuration having a base portion extending horizontally from a vertical, gripping portion, with the umbrella opened in an upright protective position, a bore extending inwardly from a free end of the base portion, a battery, a bulb, a reflector and a coil spring received in said bore, a threaded annular translucent lens cap threadedly received on the free end of said base portion, and a transparent lens fixedly secured to said lens cap closing the bore, with the lens and reflector having their optical axes extending along the handle base portion so as to direct light from the bulb through the free end of the base portion in a horizontal direction with the lens cap enabling a portion of the light to be emitted in radial directions in a vertical plane at the end of the annular base portion, an on-off switch mounted at an upper end of said gripping portion of said handle and circuit means extending between said on-off switch, said battery and said bulb, the vertical, gripping portion of the handle being formed with a bore extending axially inwardly from an uppermost end thereof providing a socket receiving said pole, whereby said handle is secured to said pole, further visibility to said passing motorists being provided for by said glowing and reflective strip, said flashlight handle further comprises lighting means including an optical fiber having one end fixedly secured in an opening provided through said reflector and another end of said optical fiber engages with an upwardly domed lens fixedly secured to the handle of said umbrella so that light can be omitted from both the free end of the base portion and the domed lens both vertically upwardly and in horizontal directions unobstructed by a hand holding the gripping portion of the handle.

* * * * *